US005989417A

United States Patent [19]

Fleischhacker

[11] Patent Number: 5,989,417

[45] Date of Patent: Nov. 23, 1999

[54] COVERING FOR A SEWER MANHOLE

[76] Inventor: Gerhard Fleischhacker, Mölbling 2, Treibach, Austria

[21] Appl. No.: 09/142,787

[22] PCT Filed: Mar. 18, 1997

[86] PCT No.: PCT/AT97/00057

§ 371 Date: Nov. 16, 1998

§ 102(e) Date: Nov. 16, 1998

[87] PCT Pub. No.: WO97/35076

PCT Pub. Date: Sep. 25, 1997

[30] Foreign Application Priority Data

Mar. 19, 1996 [AT] Austria ..... 153/96 U

[51] Int. Cl.[6] ..... E03F 5/06; E02D 29/14

[52] U.S. Cl. ..... 210/163; 210/165; 210/170; 210/484; 210/488; 210/502.1; 210/908; 404/4

[58] Field of Search ..... 210/163–165, 210/170, 232, 337, 454, 459, 484, 485, 488, 489, 492, 502.1, 908, 680; 404/2, 4

[56] References Cited

U.S. PATENT DOCUMENTS

| | | |
|---|---|---|
| 139,922 | 6/1873 | Savery . |
| 2,705,542 | 8/1955 | Yavitch . |
| 3,246,582 | 4/1966 | Wade . |
| 4,050,839 | 9/1977 | Vollmar . |
| 4,597,692 | 7/1986 | Gruenwald . |
| 4,910,811 | 3/1990 | Izzi, Sr. . |
| 4,973,191 | 11/1990 | Dannhauser . |
| 4,988,234 | 1/1991 | Henkel et al. . |
| 5,037,541 | 8/1991 | Ruey-Jang et al. . |
| 5,223,154 | 6/1993 | MacPherson, Jr. et al. . |

FOREIGN PATENT DOCUMENTS

| | | |
|---|---|---|
| 0610612 | 8/1994 | European Pat. Off. . |
| 9401198 | 9/1994 | Germany . |
| 2236132 | 3/1991 | United Kingdom . |
| WO9425676 | 11/1994 | WIPO . |

*Primary Examiner*—Richard L. Chiesa
*Assistant Examiner*—Fred Prince
*Attorney, Agent, or Firm*—Sughrue, Mion, Zinn, Macpeak & Seas, PLLC

[57] ABSTRACT

A cover for a sewage shaft comprising a shaft lid (1) including apertures (2) for the passage of sewage, a filtering element (3) spanning the region of the apertures (2) being arranged at the lower side of this lid, wherein the filtering element (3) projects into the apertures (2) and, at its upper side, ends substantially flush with the upper side of the shaft lid (1).

6 Claims, 1 Drawing Sheet

COVERING FOR A SEWER MANHOLE

The present invention relates to a cover for a sewage shaft comprising a shaft lid including apertures for the passage of sewage, a filtering element spanning the region of the apertures being arranged at the lower side of this lid.

With sewage shaft covers there is the problem that—with the exception of larger rocks or the like which cannot pass the apertures of the shaft lid—all the contaminations contained in the sewage, such as dirt particules, sand, contaminating oil etc. get into the sewage shaft unimpeded and may lead to deposits in the sewage system or become burdens on the environment, respectively.

From U.S. 5,037,541 a cover of the initially mentioned type is known in which the filtering element consists of several superposed layers of metal lattices which are held by a basket at the lower side of the shaft lid and have decreasing mesh widths from layer to layer in the direction flowed through. This structure is complex to produce, on the one hand, and in practice leads to a rapid clogging of the apertures of the filtering element, on the other hand.

The invention has as its object to provide a cover for a sewage shaft in which this problem has been eliminated. This object is achieved with a cover of the initially mentioned type, which according to the invention is characterized in that the filtering element projects into the apertures and, at its upper side, ends substantially flush with the upper side of the shaft lid.

In this manner a shaft cover having a filtering effect is provided, which prevents sand, dirt as well as contaminating oil or the like from getting into the sewage shaft. The special design of the filtering element prevents the apertures from being clogged with dirt particles, and, moreover, the filtering element can be produced as a single, coherent part.

According to a preferred embodiment of the invention, the filtering element is assembled at least of a base layer and of a superposed thin attachment layer which entirely comes to lie in the apertures, the free flowed-through cross-section of the layers increasing from top towards the bottom from layer to layer. This type of filter is known per se from Austrian Patent No. 400,960 in combination with a bottom fastening device and unfolds an excellent filtering effect; solids contained in the sewage can enter into the first layer only up to a certain grain size; however, if they have penetrated thereinto, they do not clog the filtering element on account of the increasing size of the free flowed-through cross-section in the following layers, much rather, they are discharged. Possible contaminations of the sewage, e.g. oils or petrols, are absorbed by the filtering element to a certain degree and regenerated in a biological degradation process which is accelerated in the consecutive layers of increasing air volume. The porosity of the material simultaneously causes an automatic ventilation of the filtering element.

These functions are assisted if, according to a further embodiment of the invention, the clear width of the apertures remains equal or, in particular, increases from top towards the bottom.

It is particularly advantageous if the filtering element at its lower side is provided with depressions. The depressions additionally increase the flowed-through cross-section in the lower region of the filtering element.

The filtering element may be made of single or multi-grain concrete or the like porous materials, e.g. asphalt mixtures, synthetic materials etc. It is particularly advantageous if the filtering element is made of highly abrasion-resistant porous synthetic materials. Such materials are particularly resistant to changing loads and stresses due to vibrations.

According to a further feature of the invention it is preferably provided that the filtering element is held by a lattice-like supporting basket attached to the shaft lid, whereby the structural strength of the cover is further improved.

BRIEF DESCRIPTION OF THE DRAWINGS

The invention will now be explained in more detail by way of an exemplary embodiment illustrated in the drawings. In the drawings.

DESCRIPTION OF THE PREFERRED EMBODIMENTS

Figure 1:
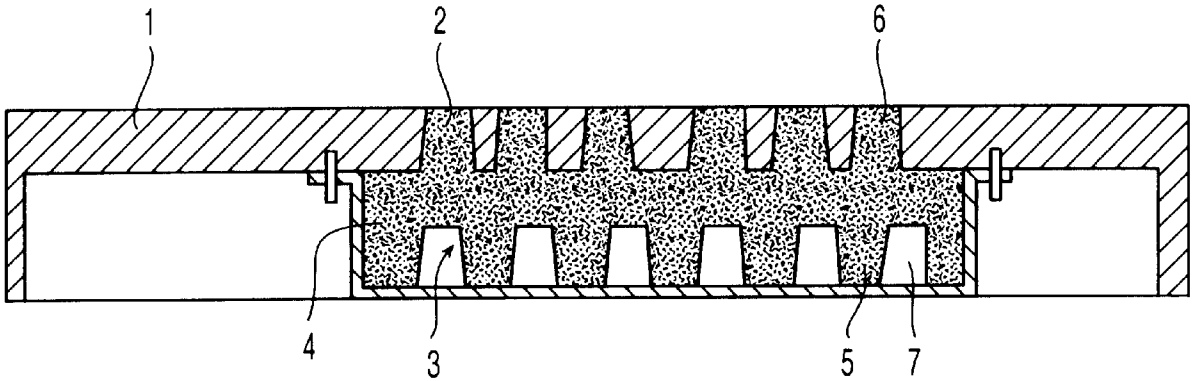
FIG. 1 shows a cross-section through the cover according to the invention.
Figure 2:
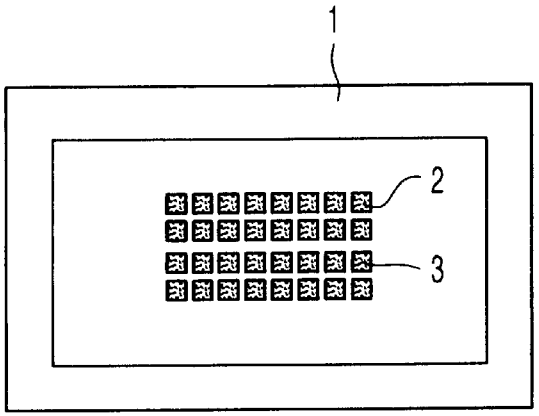
FIG. 2 shows a top view onto the cover of FIG. 1.
Figure 3:
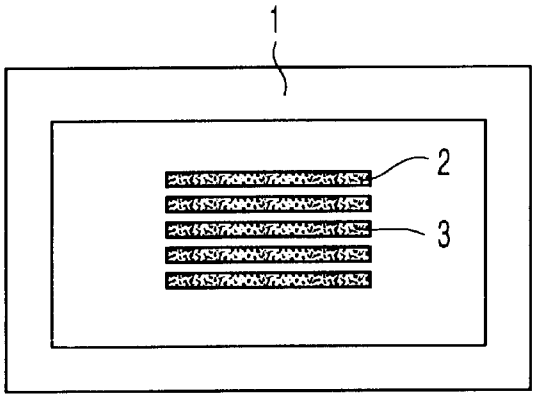
FIG. 3 shows a top view on an alternative embodiment of the cover according to the invention.
Figure 4:
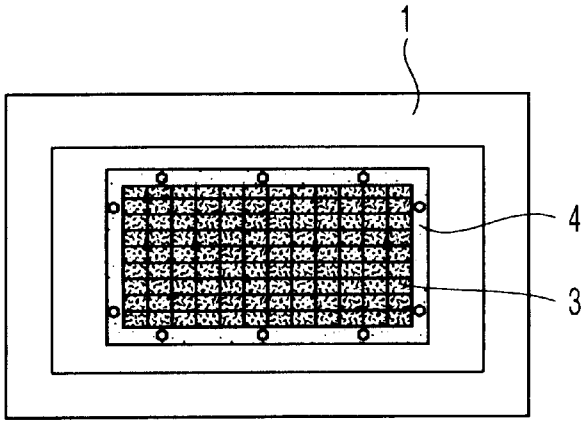
FIG. 4 shows a bottom view of the covers of FIGS. 1, 2 and 3, respectively.

The cover comprises a rectangular shaft lid 1, e.g. made of metal, which includes apertures 2 for the passage of sewage. The apertures 2 may, e.g., be grouped like a screen (FIG. 2) or like strips (FIG. 3).

On the bottom side of the shaft lid 1, a filtering element 3 is arranged which at its upper side is designed to be complementary to the apertures 2, engages in the latter and completely fills the same so that its upper side ends substantially flush with the upper side of the shaft lid 1. The filtering element 3 is held by a grid-like supporting basket 4 which is attached to the lower side of the shaft lid 1.

The filtering element 3 has a multi-layered structure, two layers in the instance illustrated, i.e. a base layer 5 and a superposed thin attachment layer 6, the free flowed-through cross-section of the base layer 5 being larger than that of the attachment layer 6. In addition, the filtering element 3 is provided with depressions 7 at its lower side whose clear width decreases towards the bottom of the depression so that the flowed-through cross-section of the base layer 5, at the level of the depressions 7 at first sharply and later on gradually increases in downward direction.

The filtering element 3 or its layers 5, 7, respectively, may be made of any desired water-permeable material, preferably single or multi-grain concrete of different grain sizes, different porous asphalt mixtures and, in particular, highly abrasion-resistant, differently porous synthetic materials. Instead of the rectangular shape illustrated, the shaft lid 1 may have any desired shape, and also the number, shape and arrangement of the apertures 2 is arbitrary.

I claim:

1. A cover for a sewage shaft comprising a shaft lid (1) including apertures (2) for the passage of sewage, a filtering element (3) spanning the region of the apertures (2) being arranged at the lower side of this lid, characterized in that the filtering element (3) projects into the apertures (2) and, at its upper side, ends substantially flush with the upper side of the shaft lid (1).

2. A cover according to claim 1, characterized in that the filtering element (3) is assembled at least of a base layer (5) and a superposed thin attachment layer (6) which entirely comes to lie in the apertures (2), the free flowed-through cross-section of the layers (5, 6) increasing from top towards the bottom from layer to layer.

3. A cover according to claim 1, characterized in that the clear width of the apertures (2) remains equal or increases from top towards the bottom.

4. A cover according to claim 1, characterized in that the filtering element (3) at its lower side is provided with depressions (7).

5. A cover according to claim 1, characterized in that the filtering element (3) is made of highly abrasion-resistant porous synthetic materials.

6. A cover according to claim 1, characterized in that the filtering element (3) is held by a latticed supporting basket (4) attached to the shaft lid (1).

* * * * *